US009820523B2

(12) United States Patent
Gaudillere

(10) Patent No.: US 9,820,523 B2
(45) Date of Patent: Nov. 21, 2017

(54) ADJUSTMENT DEVICE OF THE POSITION OF A FIRST PART WITH RESPECT TO A SECOND PART AND PROTECTIVE HELMET COMPRISING ONE SUCH DEVICE

(71) Applicant: ZEDEL, Crolles (FR)

(72) Inventor: Antonin Gaudillere, Saint Martin d'Hères (FR)

(73) Assignee: ZEDEL, Crolles (FR)

( * ) Notice: Subject to any disclaimer, the term of this patent is extended or adjusted under 35 U.S.C. 154(b) by 0 days.

(21) Appl. No.: 14/990,229

(22) Filed: Jan. 7, 2016

(65) Prior Publication Data

US 2016/0192726 A1 Jul. 7, 2016

(30) Foreign Application Priority Data

Jan. 7, 2015 (FR) ..... 15 50112

(51) Int. Cl.
*A42B 3/08* (2006.01)
*A42B 3/14* (2006.01)

(52) U.S. Cl.
CPC ..... *A42B 3/085* (2013.01); *A42B 3/145* (2013.01)

(58) Field of Classification Search
CPC ..... A42B 3/085; A42B 3/145
See application file for complete search history.

(56) References Cited

U.S. PATENT DOCUMENTS 2,437,748 A * 3/1948 Malcom ..... A42B 3/145 2/183
3,500,474 A * 3/1970 Austin ..... A42B 3/145 2/418
6,332,227 B1 * 12/2001 Fang ..... A42B 3/145 2/183
2009/0320186 A1 12/2009 Petzl et al.
2011/0191946 A1 * 8/2011 Fang ..... A42B 3/145 2/418
2016/0192726 A1 * 7/2016 Gaudillere ..... A42B 3/145 2/421

FOREIGN PATENT DOCUMENTS

EP 2138061 A1 12/2009
GB 2 354 928 A 4/2001

* cited by examiner

*Primary Examiner* — Shaun R Hurley
*Assistant Examiner* — Andrew W Sutton
(74) *Attorney, Agent, or Firm* — Oliff PLC

(57) ABSTRACT

An adjustment device of the position of a first part with respect to a second part, comprising an adjustment button mounted movable in translation inside a groove provided in the second part, and a blocking part having a locked position in which the blocking part prevents the first part from translating along the groove, and a locked position in which the blocking part enables the first part to translate along the groove, the adjustment button translating along the groove to move the blocking part to the unlocked position and to translate the first part along the groove.

7 Claims, 3 Drawing Sheets

ADJUSTMENT DEVICE OF THE POSITION OF A FIRST PART WITH RESPECT TO A SECOND PART AND PROTECTIVE HELMET COMPRISING ONE SUCH DEVICE

BACKGROUND OF THE INVENTION

The invention relates to an adjustment device of the position of a first part with respect to a second part, and relates more particularly to protective helmets comprising one such device.

STATE OF THE ART

European Patent application EP2138061 can be cited which discloses a protective helmet composed of a crown and a neckband adjustable by adjustment means. The adjustment means comprise a slot formed in the crown, a rack formed by two series of teeth separated by the slot, and a slide movable from the outside in the slot. The slide is further equipped with an unlocking button provided with spigots cooperating by clipping with the rack to block the adjustment of the neckband in a chosen adjustment position. To adjust the neckband, the user presses on the unlocking button to make the spigots come out of the rack, then moves the slide in translation in the slot until the neckband comes into contact with the user's neck. But the adjustment means are complex. They require a bias spring to keep the spigots in the rack in order to guarantee blocking of the neckband in position. Furthermore, the adjustment means are not simple to use as the user has to keep the unlocking button pressed while translating the slide.

OBJECT OF THE INVENTION

One object of the invention consists in palliating these shortcomings, and more particularly in providing an adjustment device that is efficient and simple to use.

Another object of the invention consists in providing a protective helmet equipped with such an adjustment device.

According to one feature of the invention, an adjustment device of the position of a first part with respect to a second part is proposed, comprising:

- an adjustment button mounted movable in translation inside a groove provided in the second part, and
- a blocking part having a locked position in which the blocking part prevents the first part from translating along the groove, and an unlocked position in which the blocking part enables the first part to translate along the groove.

The adjustment button translates along the groove to move the blocking part to the unlocked position and to translate the first part along the groove.

Use of the adjustment button is thus facilitated, as the adjustment button simply has to be moved in a selected direction in order to move the part in the selected direction. It is no longer necessary to press on an unlocking button to unlatch the part to be moved.

The second part can comprise position indexing means, the blocking part comprises at least one spigot engaging in the indexing means when the blocking part is in the locked position, and the adjustment button disengages said at least one spigot from the indexing means when the adjustment button translates along the groove.

The blocking part can be flexible to disengage said at least one spigot from the indexing means by deformation when the adjustment button translates along the groove.

The blocking part can comprise at least one unlatching arm pressing against at least one stop of the first part, the adjustment button exerting a pressure force on said at least one unlatching arm to disengage said at least one spigot from the indexing means when the adjustment button translates along the groove.

The blocking part can further comprise two spigots extending in two directions respectively inclined with respect to two axes normal to the groove.

The blocking part can also comprise two unlatching arms respectively pressing against two stops of the first part.

The adjustment button can translate along the groove exerting a pressure force on the blocking part, and the blocking part is moved to the unlocked position when the exerted pressure force increases and remains lower than a threshold, and the adjustment button translates the first part along the groove when the exerted pressure force is higher than the threshold.

According to another feature of the invention, a protective helmet is proposed comprising a crown, a neckband and an adjustment device of the position of a first part with respect to a second part as defined in the foregoing, wherein the first part is fitted on the neckband and the second part is fitted on the crown.

BRIEF DESCRIPTION OF THE DRAWINGS

Other advantages and features will become more clearly apparent from the following description of particular embodiments of the invention given for non-restrictive example purposes and represented in the appended drawings, in which.

DETAILED DESCRIPTION

Figure 1:
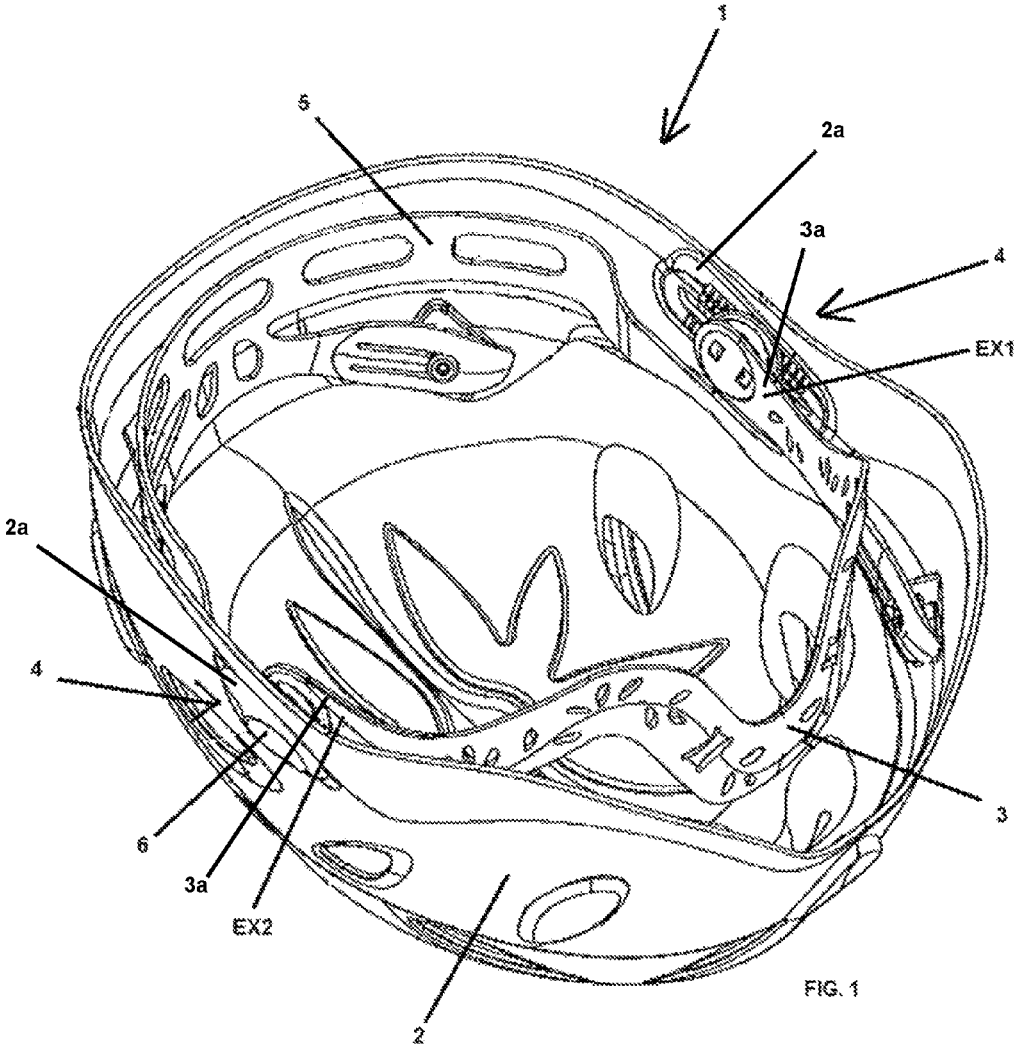
FIG. 1 schematically illustrates a perspective view of an embodiment of a protective helmet equipped with an adjustment device according to the invention.

In FIG. 1, a protective helmet 1 has been represented comprising a crown 2, a neckband 3 and an adjustment device 4 of the position of the neckband 3 with respect to the crown 2. The crown 2 is preferably made from plastic, for example from injected polycarbonate, from expanded polystyrene or from thermoformed plastic material. The neckband 3 can be a strip of flexible or semi-rigid plastic having two opposite ends EX1, EX2 and able to be in the shape of an Omega. The neckband 3 is located laid back from the inner edge of the crown 2. The crown 2 can further comprise a headband 5 extending along the inner edge of the crown 2. In the embodiment illustrated in FIG. 1, the headband 5 is not adjustable. Such a helmet 1 is particularly suitable for rock-climbing, mountaineering, and more generally for any sports activity or for working at heights.

The position of the neckband 3 is adjustable by the adjustment device 4 which comprises an adjustment button 6 accessible from the outside of the crown 5. The helmet 1 can comprise a single adjustment device 4 to adjust the position of one end of the neckband 3. Preferentially, the protective helmet 1 comprises two adjustment devices situated on the opposite lateral sides of the crown 2.

Figure 2:
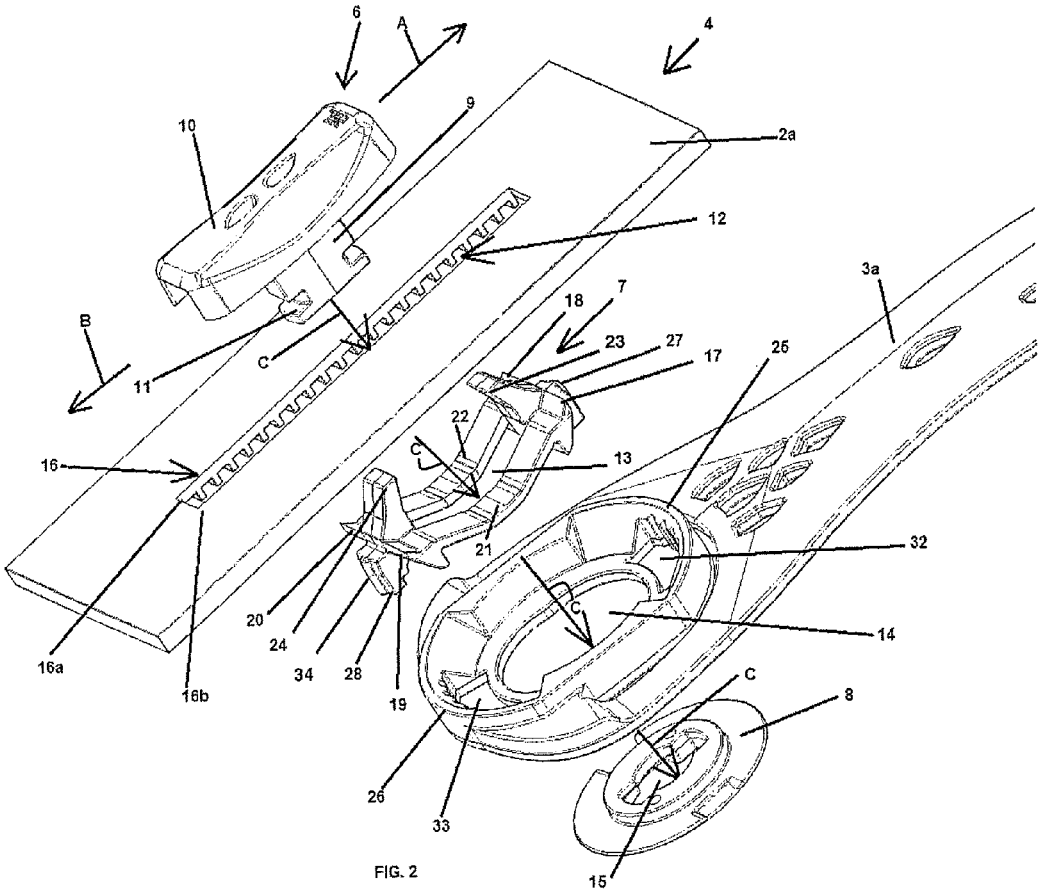
FIG. 2 schematically illustrates an exploded perspective view of another embodiment of an adjustment device according to the invention.
Figure 3:
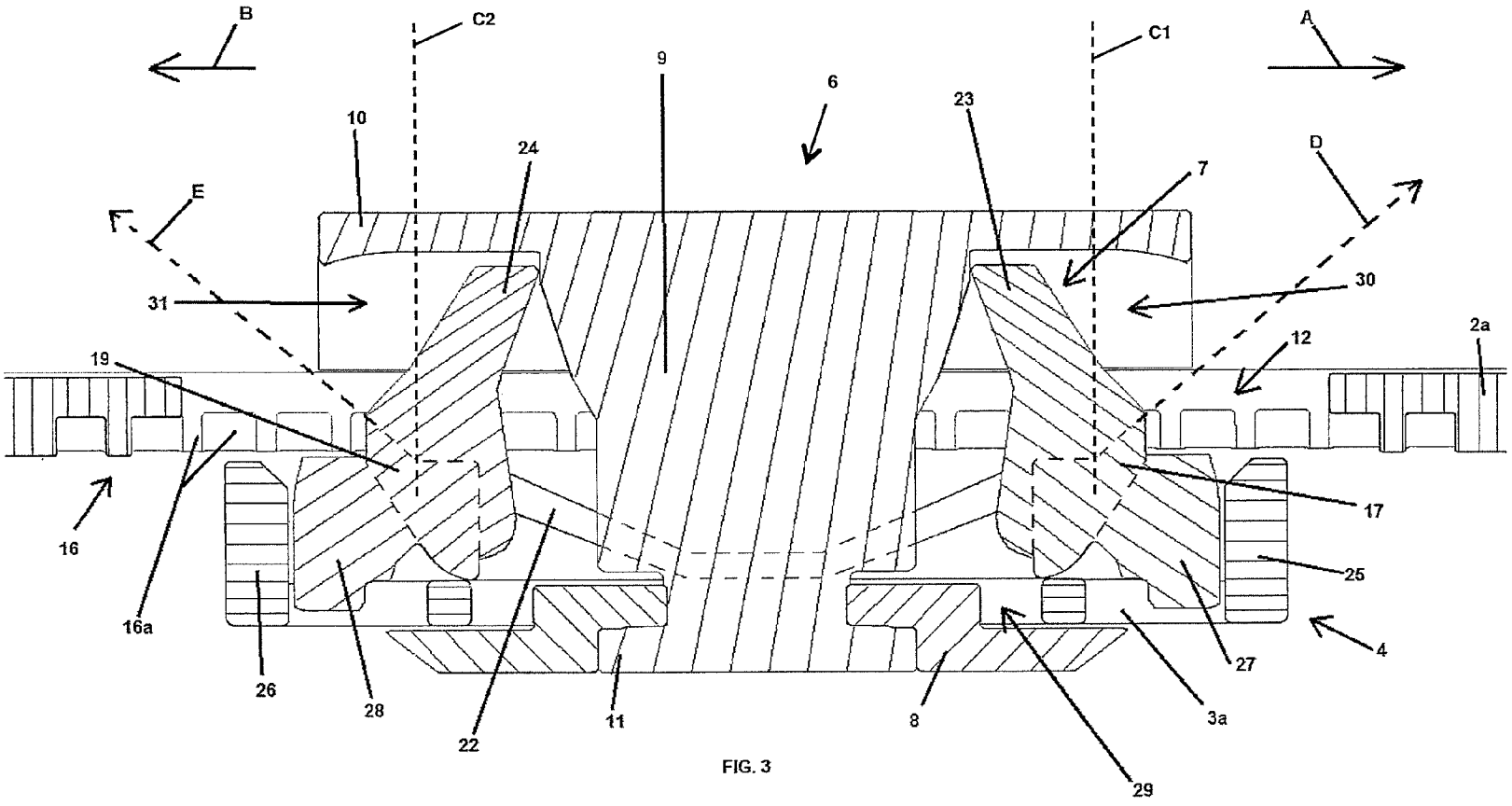
FIG. 3 illustrates in schematic manner a cross-sectional view of the adjustment device the components of which have been assembled.

In FIGS. 2 and 3, the adjustment device 4 has been represented respectively in an exploded view of the components of the device 4 and a cross-sectional view of the device 4 where its components are assembled. In general manner, the adjustment device 4 enables the position of a first part 3*a* to be adjusted with respect to a second part 2*a*. Such an adjustment device 4 is particularly suitable for protective helmets 1, and in this case, the first part 3*a* is fitted on the neckband 3 of the helmet 1, and the second part 2*a* is fitted on the crown 2 of the helmet 1.

The adjustment device 4 comprises the adjustment button 6, a blocking part 7, and a retaining washer 8. The adjustment button 6 comprises a foot 9 extended at a first end by a head 10 to enable gripping of the button 6, and extended at a second opposite end by a base part 11. The adjustment button 6 is mounted movable in translation in a groove 12 provided in the second part 2*a*. The groove 12 forms a pass-through elongated opening and the foot 9 of the adjustment button 6 can slide in the groove 12. The groove 12 can be rectilinear or curved. The groove 12 preferably has a longitudinal shape inside which the adjustment button 6 moves in translation. The groove 12 serves the purpose of guiding the movement of the adjustment button 6 in translation. The adjustment button 6 can thus translate along the groove 12 in two possible opposite translation directions A, B.

The blocking part 7, first part 3*a* and retaining washer 8 respectively comprise three pass-through holes 13 to 15 to allow passage of the foot 9 of the adjustment button 6. When the components of the adjustment device 4 are assembled, the blocking part 7 is situated between the first and second parts 3*a*, 2*a*, the second part 2*a* is situated between the head 10 of the adjustment button and the blocking part 7, and the foot 9 of the button 6 passes consecutively through the groove 12, the pass-through hole 13 of the blocking part 7, the pass-through hole 14 of the first part 3*a*, and the pass-through hole 15 of the retaining washer 8. The retaining washer 8 enables the components of the adjustment device 4 to be kept together. Thus, the adjustment button 6, blocking part 7, first part 3*a* and retaining washer 8 are securely fixed to one another and can be translated together with respect to the second part 2*a*. When assembly of the components is performed, the foot 9 of the adjustment button 6 is inserted along an axis C normal to the groove 12, and the retaining washer 8 is then fitted to secure the assembly together.

The blocking part 7 prevents the first part 3*a* from translating along the groove 12 when the adjustment button 6 is in an initial position. The adjustment button 6 in the initial position has been illustrated in FIG. 3. In the initial position, if the user pulls on the first part 3*a*, in either of the two translation directions A, B, the blocking part 7 blocks the first part 3*a* and prevents it from translating. There is therefore no possible incorrect adjustment of the first part 3*a* with respect to the second part 2*a*. In this case, the blocking part 7 is said to be in a locked position in which the blocking part 7 prevents the first part 3*a* from translating along the groove 12. On the contrary, when the user translates the adjustment button 6, in either the first or the second translation direction A, B, the button 6 cooperates with the blocking part 7 to move the blocking part 7 to an unlocked position and to translate the first part 3*a* with respect to the second part 2*a* along the groove 12. In the unlocked position, the blocking part 7 enables the first part 3*a* to translate along the groove 12.

For example, the second part 2*a* can comprise position indexing means 16, for example a position indexer, designed to maintain the second part 2*a* in a chosen position. In FIG. 1, the indexing means 16 are fitted on the crown 2. For example, the indexing means 16 are formed on the crown 2 by moulding. In a general manner, the indexing means 16 are oriented in the direction of the first part 3*a*, i.e. they are situated facing the first part 3*a*. In the embodiment illustrated in FIG. 1, the indexing means 16 are located on the inner edge of the crown 2. The indexing means 16 can comprise at least one rack 16*a*, 16*b*. Each rack 16*a*, 16*b* comprises a series of teeth and a series of notches, in which two successive teeth are separated from one another by a notch. Preferably, the indexing means 16 comprise two racks 16*a*, 16*b* parallel to one another and separated from one another by the groove 12.

The blocking part 7 comprises at least one spigot 17 to 20 configured to engage in the indexing means 16 in order to block the first part 3*a* in position, i.e. to prevent the first part 3*a* from translating along the groove 12 when the adjustment button 6 is in its initial position and does not translate. In the locked position of the blocking part 7, at least one spigot 17 to 20 engages in a notch of at least one rack 16*a*, 16*b*. According to a variant, the blocking part 7 comprises two spigots 17, 20 situated opposite one another along an axis parallel to the groove 12. In this case, in the locked position of the blocking part 7, the first spigot 17 prevents translation of the first part 3*a* in the first direction A, and the second spigot 19 prevents translation of the first part 3*a* in the second direction B. Advantageously, when the indexing means 16 comprise two racks 16*a*, 16*b*, the blocking part 7 comprises a first pair of spigots 17, 18 designed to respectively engage in the notches of the two racks 16*a*, 16*b* to prevent translation of the first part 3*a* in the first direction A, and a second pair of spigots 19, 20 designed to respectively engage in the notches of the two racks 16*a*, 16*b* to prevent translation of the first part 3*a* in the second direction B.

When the adjustment button 6 translates along the groove 12, it cooperates with the blocking part 7 so as to disengage the spigots 17, 18 of the first pair from the notches where they are located in order to release the first part 3*a*. The adjustment button 6 thus moves the blocking part 7 to the unlocked position and can translate the first part 3*a* along the groove 12.

In general manner, the blocking part 7 is flexible to disengage the spigots 17 to 20 from the indexing means 16 by deformation when the adjustment button 6 translates along the groove 12. For example, the blocking part 7 can comprise two flexible blades 21, 22 to make the blocking part 7 deformable. The blades 21, 22 deform to enable disengagement of the spigots 17 to 20 from the indexing means 16, and to move the spigots into the next notches after they have passed the teeth which were blocking them. The blades 21, 22 are located on each side of the pass-through hole 13 of the blocking part 7.

The adjustment part 7 can further comprise at least one unlatching arm 23, 24. When the adjustment part 7 comprises a spigot 17, or a pair of spigots 17, 18, it comprises an unlatching arm 23 located at the level of the spigots 17, 18, preferably located between the two spigots 17, 18. When the adjustment part 7 comprises two opposite spigots 17, 19 located on the same axis parallel to the groove 12, or two pairs of spigots 17 to 20, it comprises two unlatching arms 23, 24. A first arm 23 presses against a main stop 25 situated on the first part 3*a*. The first part 3*a* can also comprise a secondary stop 26 to enable pressing of the second arm 24. Each unlatching arm 23, 24 is designed to deform the blocking part 7 when the adjustment button 6 translates in a translation direction A, B. In particular, when the button translates in the first direction A, it exerts a pressure force on the first arm 23 to disengage the first pair of spigots 17, 18 from the indexing means 16. When the adjustment button 6 translates in the second direction B, it exerts a pressure force on the second arm 24 to disengage the second pair of spigots 19, 20 from the indexing means 16. In other words, when the adjustment button 6 translates in a direction A, B, it pushes the unlatching arm 23, 24 which presses on a stop 25, 26 of the first part 3*a* to translate the spigots 17 to 20 in the direction of the first part 3*a* along an axis normal to the groove 12. Pressing of a latching arm 23, 24 against a stop 25, 26 is performed by an extension of the arm which forms a pressing head 27, 28 coming into contact with a stop 24, 25 of the first part 3*a*. As the pressing head 27 is situated against the stop 25, the latching arm 23 performs according to an axis perpendicular to the translation direction A of the adjustment button 6 and perpendicular to the axis C normal to the groove 12. Rotation of the unlatching arm 23 results in a deformation of the flexible blades 21, 22 which tend to be flattened. Deformation of the blades 21, 22 then disengages the spigots 17, 18 from the racks 16*b*, 16*a*. An unlatching arm 23, 24 thus transmits the force exerted by the adjustment button 6 along the axis of the groove 12 into a force on the spigots along an axis normal to to the groove 12 in order to disengage the spigots from the notches where they were located. The blocking part 7 is moved to the unlocked position when the spigots are disengaged. Furthermore, when the spigots disengage from the notches, only the adjustment button 6 translates with respect to the first and second parts 3*a*, 2*a*. A free space 29 further exists between the retaining washer 8 and the stops 25, 26 to enable translation of the adjustment button 6 in order to disengage the spigots. Translation of the adjustment button 6 enabling the spigots to be disengaged is also called first translation. More particularly, the first translation is performed when the pressure force exerted increases and remains lower than a threshold. Then translation of the adjustment button 6 continues, prolonging the force exerted on the unlatching arm, the spigots pass the teeth which were keeping them in the notches, and the first part 3*a* translates, with the adjustment button 6 and in the same direction, with respect to the second part 2*a* along the groove 12. Translation of the adjustment button 6 enabling the spigots to pass the teeth is also called second translation. The second translation is performed when the pressure force exerted is higher than the above-mentioned threshold. In other words, when the second translation takes place, an unlatching arm pushes the stop against which it is pressing, and therefore pushes the first part 3*a* in the same direction as that of the adjustment button 6.

It can be noted that the adjustment button 6 comprises at least one recess 30, 31 to house an unlatching arm 23, 24. Preferably, the adjustment button 6 comprises two recesses 30, 31 to respectively receive the two unlatching arms 23, 24. These recesses 30, 31 enable a free space to be created for movement of the adjustment button 6 with respect to an unlatching arm 23, 24 when the adjustment button 6 exerts a pressure on the other unlatching arm 23, 24, and vice versa.

The disengaged spigots 17 to 20 pass the teeth and come and house themselves in the next notches, by means of the bias force of the flexible blades 21, 22. In particular, when the first pair of spigots 17, 18 pass the teeth, the opposite spigots 19, 20 also pass the teeth which were retaining them by means of an inclination of the spigots. In a preferred embodiment, the blocking part 7 comprises spigots 17 to 20 extending in two directions D, E respectively inclined with respect to two axes C1, C2 normal to the groove 12. Furthermore, the directions D, E of the spigots are inclined in two opposite directions A, B. The adjustment device 4 thus enables the spigots 17, 18 of the first pair to be disengaged by moving the adjustment button 6 in the first direction of movement A, and the spigots 19, 20 of the second pair pass the teeth due to their inclination. When the adjustment button 6 translates in the opposite direction B, the spigots 19, 20 of the second pair are disengaged from the racks 16*b*, 16*a*, and the spigots 17, 18 of the first pair pass the teeth due to their inclination. As a variant, the spigots 17, 18 of the first pair can have a different inclination from that of the spigots 19, 20 of the second pair, in order in particular to make one of the directions of translation A, B of the adjustment button 6 more difficult.

The adjustment device 4 also operates with a single unlatching arm and a single spigot (or two spigots) which are disengaged in one direction or in the other by exerting a force on one side or the other of the unlatching arm by means of the adjustment button 6 which is translated in one direction A or the other B. Any change of adjustment results in an audible click being emitted by the spigots 17 to 20 following movement of the blocking part 7.

As a variant, the heads 27, 28 of the unlocking arms are inserted in pass-through apertures 32, 33 provided in the first part 3*a*. The first part 3*a* can thus be movable in rotation around the axis C normal to the groove 12 to incline the first part 3*a* with respect to the second part 2*a*. Preferably, each head 27, 28 of the unlatching arms 23, 24 can comprise a rounded tab 34 which cooperates with slots provided in the stops 25, 26 so as to be able to adjust the angular position of the first part 3*a*.

Adjustment of the position of the neckband 3 is performed by translating the adjustment button 6. More particular, when the protective helmet 1 comprises two adjustment devices 4, the user moves the adjustment buttons in translation, using both hands, either towards the front of the helmet 1 to tighten the helmet 1 on his neck, or towards the rear of the helmet 1 to loosen the helmet. The spigots disengage from the notches to release the ends EX1, EX2 of the neckband 3. Then the spigot of each device 4 passes a tooth and engages again in the next notch, again performing blocking of the adjustment of the neckband in the selected position. The user moves the adjustment button of a device 1 in translation in the groove 12 until the neckband comes into contact against the user's neck.

The length of the neckband remains constant during adjustment, whereas its attachment point is made to vary by means of the indexing means 16 situated on the inner wall of the crown 2.

The invention claimed is:

1. An adjustment device of the position of a first part with respect to a second part, comprising:

an adjustment button mounted movable in translation inside a groove provided in the second part;

a blocking part having a locked position in which the blocking part prevents the first part from translating along the groove, and an unlocked position in which the blocking part enables the first part to translate along the groove;

the adjustment button being configured to translate along the groove to move the blocking part to the unlocked position and to translate the first part along the groove;

the second part comprises a position indexer, and the blocking part comprises at least one spigot engaging in the position indexer when the blocking part is in the locked position, and the adjustment button disengages said at least one spigot from the position indexer when the adjustment button translates along the groove.

2. The adjustment device according to claim 1, wherein the blocking part is flexible to disengage said at least one spigot from the position indexer by deformation when the adjustment button translates along the groove.

3. The adjustment device according to claim 1, wherein the blocking part comprises at least one unlatching arm pressing against at least one stop of the first part, the adjustment button exerting a pressure force on said at least one unlatching arm to disengage said at least one spigot from the position indexer when the adjustment button translates along the groove.

4. The adjustment device according to claim 1, wherein the blocking part comprises two spigots extending in two directions respectively inclined with respect to two axes normal to the groove.

5. The adjustment device according to claim 3, wherein the blocking part comprises two unlatching arms respectively pressing against two stops of the first part.

6. The adjustment device according to claim 1, wherein the adjustment button translates along the groove exerting a pressure force on the blocking part, and the blocking part is moved to the unlocked position when the exerted pressure force increases and remains lower than a threshold, and the adjustment button translates the first part along the groove when the exerted pressure force is higher than the threshold.

7. A protective helmet comprising a crown, a neckband and an adjustment device of the position of a first part with respect to a second part according to claim 1, wherein the first part is fitted on the neckband and the second part is fitted on the crown.

* * * * *